US006132194A

United States Patent [19]

Wenker et al.

[11] Patent Number: 6,132,194

[45] Date of Patent: Oct. 17, 2000

[54] LOW COST COMPACT DESIGN INTEGRAL BRAKE

[75] Inventors: Wayne B. Wenker, Eden Prairie; Michael W. Barto, Shakopee; Scott E. Yakimow, Burnsville, all of Minn.

[73] Assignee: Eaton Corporation, Cleveland, Ohio

[21] Appl. No.: 09/325,271

[22] Filed: Jun. 3, 1999

[51] Int. Cl.[7] ..... F03C 2/00

[52] U.S. Cl. ..... 418/61.3; 418/181

[58] Field of Search ..... 418/61.3, 181

[56] References Cited

U.S. PATENT DOCUMENTS

| | | | |
|---|---|---|---|
| 3,087,436 | 4/1963 | Dettlof et al. | 418/61.3 |
| 3,616,882 | 11/1971 | White . | |
| 3,960,470 | 6/1976 | Kinder . | |
| 4,493,404 | 1/1985 | Wenker | 418/61.3 |
| 4,597,476 | 7/1986 | Wenker | 192/3 R |
| 4,613,292 | 9/1986 | Bernstrom et al. | 418/61.3 |
| 4,981,423 | 1/1991 | Bissonnette . | |
| 5,144,324 | 9/1992 | Spindeldreher | 418/61.6 |
| 6,602,835 | 5/2000 | Acharya et al. | 418/61.3 |

FOREIGN PATENT DOCUMENTS

| | | | |
|---|---|---|---|
| 3125087 | 1/1983 | Germany | 418/61.3 |
| 8401800 | 5/1984 | WIPO | 418/61.3 |

*Primary Examiner*—Thomas Denion
*Assistant Examiner*—Theresa Trieu
*Attorney, Agent, or Firm*—L. J. Kasper

[57] ABSTRACT

An integral brake assembly for a gerotor motor of the type including valving (41) disposed forwardly of the gerotor gear set (15). Orbital and rotational movement of the gerotor star member (31) is transmitted to an output shaft (43) by a main drive shaft (51), which includes a rearwardly extending brake portion (107). The motor includes an endcap assembly (21) defining a brake chamber (73) into which the brake portion (107) extends. A cylindrical brake member (91) is disposed in the brake chamber (73), and includes a circular surface (109) for frictional engagement with a lock piston (75). The brake member (91) also includes a forward generally annular surface (115) for frictional engagement with either the gerotor gear set (15) or an adjacent wear plate (89). The invention at least reduces the need for expensive friction discs in order to achieve a desired level of brake torque, and also utilizes inherent friction in various brake parts for some of the required brake torque.

4 Claims, 3 Drawing Sheets

LOW COST COMPACT DESIGN INTEGRAL BRAKE

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to rotary fluid pressure devices, and more particularly, to such devices of the type including a fluid displacement mechanism which comprises a gerotor gear set.

Although the present invention may be included in a gerotor-type device being utilized as a pump, it is especially adapted for use in a low-speed, high-torque gerotor motor, and will be described in connection therewith.

For years, many of the gerotor motors made and sold commercially, both by the assignee of the present invention as well as by others, have had the motor valving disposed "forwardly" of the gerotor gear set (i.e., toward the output shaft end of the motor), thus having nothing disposed "rearwardly" of the gerotor gear set except for an endcap. The present invention is not so limited, but is especially adapted for use with gerotor motors of this type, and will be illustrated and described in connection therewith.

In many vehicle applications for low-speed, high-torque gerotor motors, it is desirable for the motor to have some sort of parking brake or parking lock, the term "lock" being preferred in some instances because it is intended that the parking lock be engaged only after the vehicle is stopped. In other words, such parking lock devices are not intended to be dynamic brakes, which would be engaged while the vehicle is moving, to bring the vehicle to a stop. However, the term "brake" will generally be used hereinafter to mean and include both brakes and locks, the term "brake" being somewhat preferred to distinguish from a device which would operate either fully engaged or fully disengaged.

For many years, those skilled in the art have attempted to incorporate brake and lock devices into gerotor motors, as opposed to merely adding a brake package on the motor output shaft. Examples of such devices are illustrated and described in U.S. Pat. Nos. 3,616,882 and 4,981,423. In the device of U.S. Pat. No. 3,616,882, a braking element is disposed adjacent the forward end of the gerotor star, and is biased by fluid pressure into frictional engagement therewith. Such an arrangement involves a certain degree of unpredictability of performance, in view of variations in clearances, etc. Such an arrangement also requires a substantial redesign of the wear plate and forward bearing housing of the motor. In the device of U.S. Pat. No. 4,981,423, there is a multi-disc brake assembly which is of the "spring-applied, pressure-released" type. The arrangement of U.S. Pat. No. 4,981,423 also requires almost total redesign of the forward bearing housing, and also results in a much larger bearing housing. In addition, the disc pack is in splined engagement with the output shaft and, therefore, must be able to brake or hold the full output torque of the motor, thus necessitating that the discs, the spring, and the apply/release piston all be relatively larger.

In many known motor brake and lock arrangements, the majority of the braking "torque" is provided by a set of brake discs. Typically, the brake discs are provided with some sort of friction material which, while effective in increasing the braking torque, also adds substantially to the cost of the brake discs. As a result, there are many vehicle applications where it would be desirable to utilize a low-speed, high-torque gerotor motor having a built-in brake, but wherein it is not economically feasible to do so because of the expense represented by typical brake discs provided with the necessary friction material.

BRIEF SUMMARY OF THE INVENTION

Accordingly, it is an object of the present invention to provide a gerotor motor including a parking brake which overcomes the above-described disadvantages of the prior art, and is compact and of low cost.

It is a more specific object of the present invention to provide a parking brake for a gerotor motor which totally eliminates, or at least substantially reduces, the need for expensive friction-type brake discs.

It is an even more specific object of the present invention to provide such a gerotor motor parking brake which utilizes the inherent friction of several members of the brake assembly, which are in engagement with each other, to achieve at least a major portion of the braking torque.

The above and other objects of the invention are accomplished by the provision of a rotary fluid pressure device of the type including a housing defining a fluid inlet and a fluid outlet. A rotary fluid displacement mechanism includes an internally-toothed ring member and an externally-toothed star member eccentrically disposed within the ring member for orbital and rotational movement relative thereto, the star member defining a central opening. The teeth of the ring member and the star member interengage to define expanding and contracting fluid volume chambers in response to the orbital and rotational movement. Valve means cooperates with the housing to provide fluid communication from the fluid inlet to the expanding volume chambers, and from the contracting volume chambers to the fluid outlet. A drive shaft includes a driven portion in engagement with the central opening of the star member, a drive portion extending forwardly and adapted to drive an output, and a brake portion extending rearwardly and engaging in orbital and rotational movement. An endcap assembly is disposed rearwardly of the fluid displacement mechanism, and defines an internal chamber and a lock piston disposed in the internal chamber, the lock piston being moveable between a first, retracted position, and a second, engaged position.

The improved rotary fluid pressure device is characterized by the endcap assembly defining a generally cylindrical brake chamber, the brake portion of the drive shaft extending axially into the brake chamber. A generally cylindrical brake member is disposed in the brake chamber and is driven eccentrically by the brake portion of the drive shaft. The brake member includes a first, generally circular surface disposed for frictional engagement with the lock piston when the lock piston is in the engaged position. The brake member also includes a second, generally annular surface disposed for frictional engagement with the fluid displacement mechanism when the lock piston is in the engaged position.

In accordance with a more limited aspect of the invention, the improved rotary fluid pressure device is characterized by the generally cylindrical brake member including a cylindrical outer surface in frictional engagement with an internal generally cylindrical surface defined by the brake chamber when the lock piston is in its engaged position, and in response to the orbital and rotational movement of the brake portion of the drive shaft.

DETAILED DESCRIPTION OF THE PREFERRED EMBODIMENT

Figure 1:
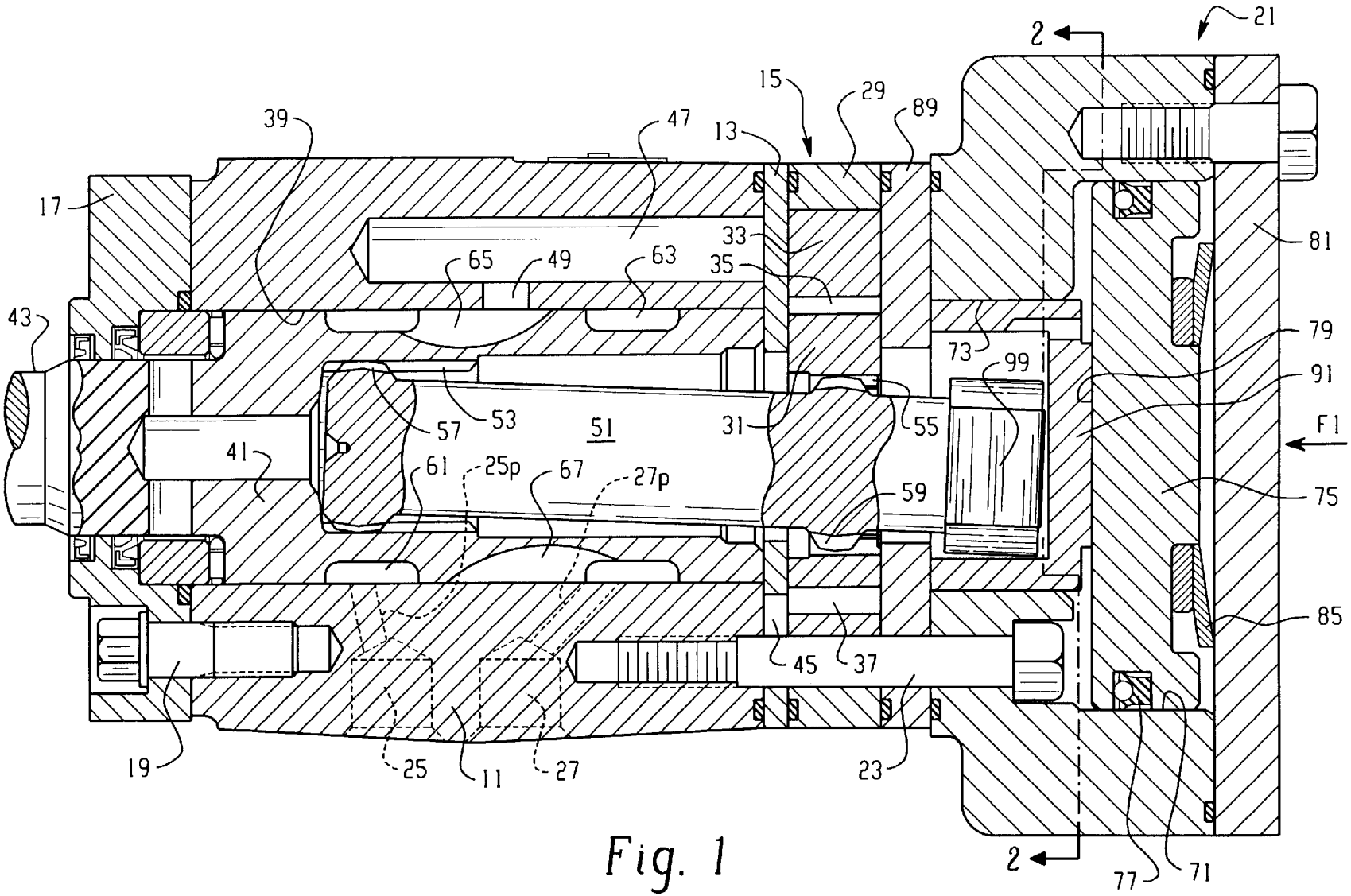
FIG. 1 is an axial cross-section of a gerotor motor including a parking brake made in accordance with the present invention.
Figure 2:
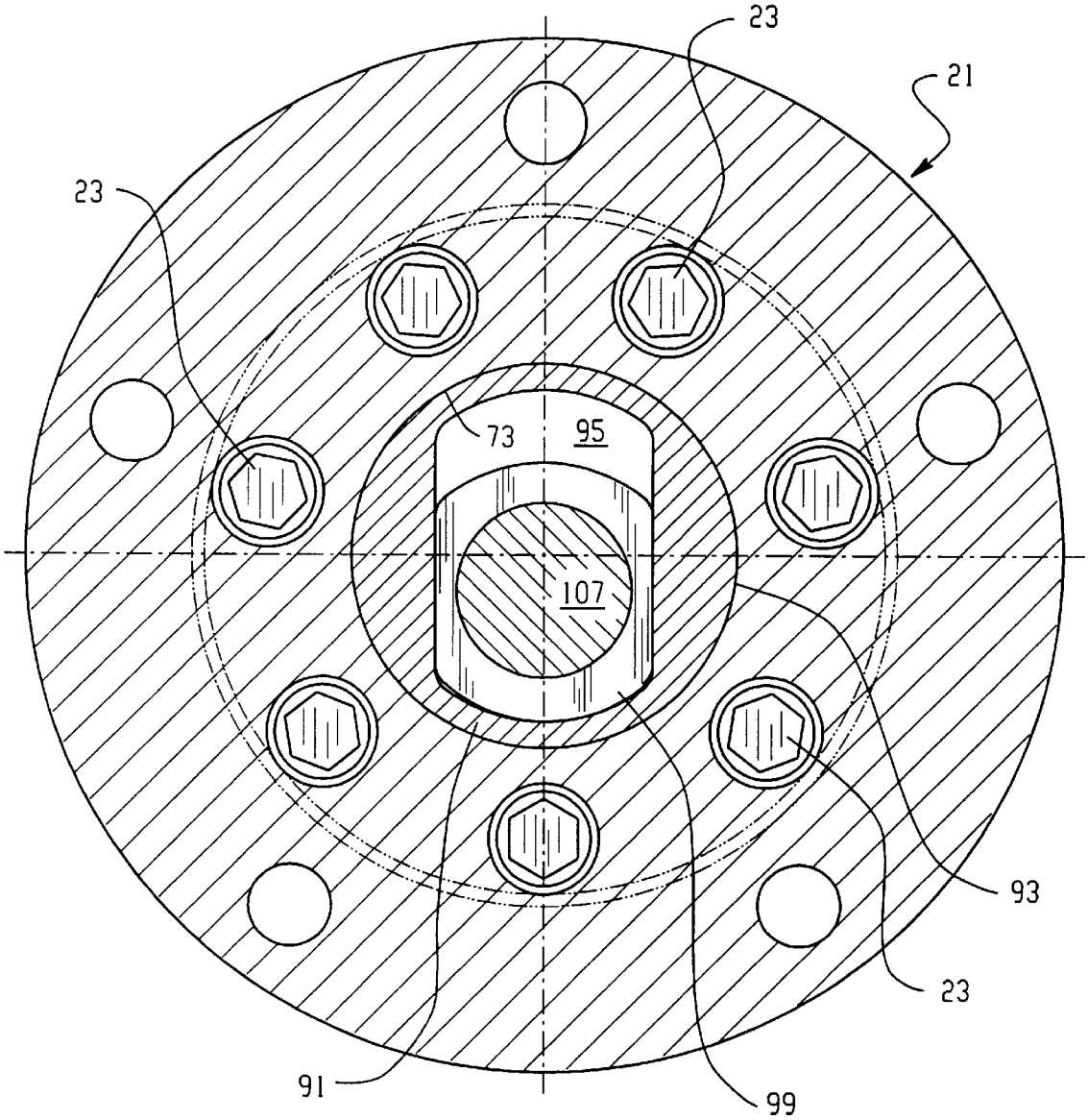
FIG. 2 is a transverse cross-section taken on line 2—2 of FIG. 1, and on approximately the same scale.

Referring now to the drawings, which are not intended to limit the invention, FIG. 1 is an axial cross-section of a low-speed, high-torque gerotor motor of the type with which the parking brake mechanism of the present invention is especially advantageous. The gerotor motor shown in FIG. 1 may be of the general type illustrated and described in U.S. Pat. No. 4,592,704, assigned to the assignee of the present invention and incorporated herein by reference.

The gerotor motor of FIG. 1 comprises a valve housing section 11, a port plate 13, and a fluid energy-translating displacement mechanism, generally designated 15, which, in the subject embodiment, is a roller gerotor gear set. The motor includes a forward endcap 17, held in tight sealing engagement with the valve housing section 11 by means of a plurality of bolts 19, and a rearward endcap assembly 21, held in tight sealing engagement with the valve housing section 11 by means of a plurality of bolts 23. The valve housing section 11 includes a fluid inlet port 25, and a fluid outlet port 27, shown only in dashed lines in FIG. 1. It is understood by those skilled in the art that the ports 25 and 27 may be reversed, thus reversing the direction of operation of the motor.

Referring still to FIG. 1, the gerotor gear set 15 includes an internally-toothed ring member 29, through which the bolts 23 pass (only one of the bolts 23 being shown in FIG. 1), and an externally-toothed star member 31. The internal teeth of the ring member 29 comprise a plurality of cylindrical rollers 33, as is now well known in the art. The teeth 33 of the ring 29 and the external teeth of the star 31 interengage to define a plurality of expanding volume chambers 35, and a plurality of contracting volume chambers 37, as is also well known in the art.

The valve housing section 11 defines a spool bore 39, and rotatably disposed therein is a spool valve 41. Formed integrally with the spool valve 41 is an output shaft 43, shown only fragmentarily in FIG. 1. In fluid communication with each of the volume chambers 35 and 37 is an opening 45 defined by the port plate 13, and in fluid communication with each of the openings 45 is an axial passage 47 formed in the valve housing section 11. Each of the axial passages 47 communicates with the spool bore 39 through an opening 49. The housing section 11 also defines fluid passages 25*p* and 27*p*, providing fluid communication between the spool bore 39 and the inlet port 25 and outlet port 27, respectively.

Disposed within the hollow, cylindrical spool valve 41 is a main drive shaft 51, commonly referred to as a "dog bone" shaft. The spool valve 41 defines a set of straight internal splines 53, and the star 31 defines a set of straight internal splines 55. The drive shaft 51 includes a set of external crowned splines 57 in engagement with the internal splines 53, and a set of external crowned splines 59 in engagement with the internal splines 55. Thus, the orbital and rotational movements of the star member 31 are transmitted, by means of the dog bone shaft 51, into purely rotational movement of the output shaft 43, as is well known in the art.

The spool valve 41 defines an annular groove 61 in continuous fluid communication with the inlet port 25, through the passage 25*p*. Similarly, the spool valve 41 defines an annular groove 63, which is in continuous fluid communication with the outlet port 27, through the passage 27*p*. The spool valve 41 further defines a plurality of axial slots 65 in communication with the annular groove 61, and a plurality of axial slots 67 in communication with the annular groove 63. The axial slots 65 and 67 are also frequently referred to as feed slots or timing slots. As is generally well known to those skilled in the art, the axial slots 65 provide fluid communication between the annular groove 61 and the openings 49, disposed on one side of the line of eccentricity of the gerotor set 15, while the axial slots 67 provide fluid communication between the annular groove 63 and the openings 49, which are on the other side of the line of eccentricity. The resulting commutating valve action between the axial slots 65 and 67 and the openings 49, as the spool valve 41 rotates, is well known in the art and will not be described further herein.

Those portions of the motor described up to this point are generally conventional and well known to those skilled in the art. Referring still primarily to FIG. 1, but also to FIG. 3, the parking brake assembly of the present invention will now be described. The rearward endcap assembly 21 defines a relatively larger, internal chamber 71, and a relatively smaller, forward internal chamber 73. In the subject embodiment, both of the chambers 71 and 73 are generally cylindrical, although it should be understood that such is not an essential feature of the invention with regard to the chamber 71. However, as a practical matter, the chamber 73 must be cylindrical, and the reference numeral "73" will be used hereinafter also for the cylindrical, internal surface of the smaller, forward chamber. Disposed within the chamber 71 is a generally cylindrical lock piston 75, which includes an o-ring seal 77 disposed about its outer periphery and in sealing engagement with the internal surface of the chamber 71. The lock piston 75 includes a forward, generally circular engagement surface 79. Disposed rearwardly of the piston 75, the internal chamber 71 is bounded by an endcap member 81, and disposed axially between the piston 75 and the endcap 81 is a Belleville washer 85, which biases the piston 75 in a forward direction (to the left in FIG. 1) toward an engaged position, as will be described in greater detail subsequently.

Referring still primarily to FIG. 1, it should be noted that there is a wear plate 89 disposed axially between the gerotor gear set 15 and the rearward endcap 21. In some applications, the wear plate 89 may not be considered essential for the proper performance of the motor, and therefore, may be omitted such that the rearward endcap 21 would be immediately adjacent the gerotor gear set 15. As a result, references hereinafter, and in the appended claims, to frictional engagement with the fluid displacement mechanism (i.e., the gerotor gear set), will be understood to mean and include either direct frictional engagement with one of the members of the gerotor gear set itself, such as the star 31, or only indirect frictional engagement with the gerotor gear set, by means of direct frictional engagement with the adjacent wear plate 89.

Figure 4:
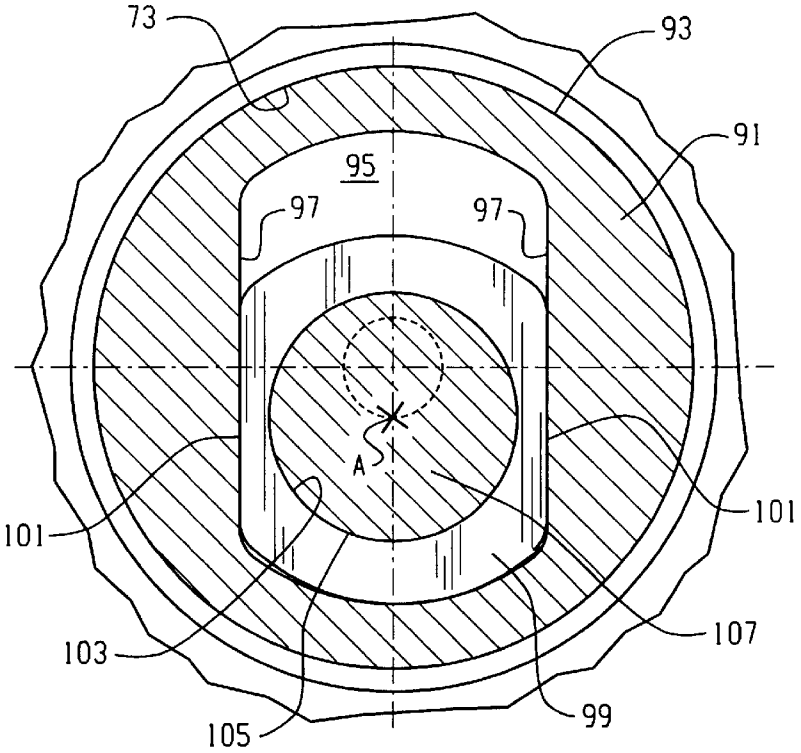
FIG. 4 is an enlarged, fragmentary, transverse cross-section, similar to FIG. 2, and on about the same scale as FIG. 3, illustrating the parking brake of the present invention.
Figure 3:
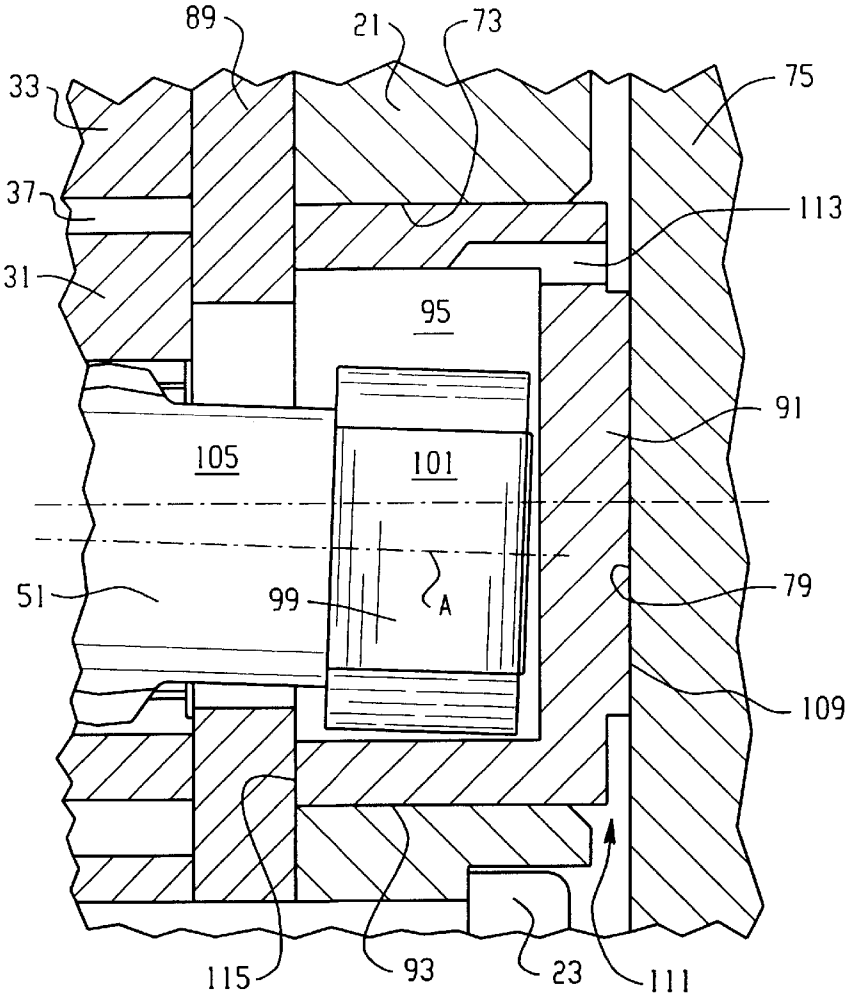
FIG. 3 is an enlarged, fragmentary, axial cross-section, similar to FIG. 1, illustrating the parking brake of the present invention in greater detail.

Disposed within the chamber 73 is a generally cylindrical brake member 91. Referring primarily to FIGS. 3 and 4, the brake member 91 includes a cylindrical outer surface 93 in closely spaced apart, sliding engagement with the cylindrical internal surface 73. The brake member 91 defines an internal chamber 95 bounded, in part, by a pair of flat surfaces 97, the function of which will become apparent subsequently. Disposed within the chamber 95 is a spinner member 99 which includes a pair of flat sides 101, each of which is in closely spaced apart, sliding engagement with one of the flat surfaces 97. Thus, the spinner member 99 is able to move slightly within the internal chamber 95, in response to the orbital and rotational movement of the main drive shaft 51.

Referring still primarily to FIG. 4, the spinner member 99 defines a cylindrical internal surface 103, and in closely spaced apart, sliding engagement therewith is an outer cylindrical surface 105 of a rearward end 107 of the main drive shaft 51. The rearward end 107 of the drive shaft 51 will also be referred to hereinafter as the "brake portion" of the drive shaft 51, in view of the fact that it is involved in the process of braking the gerotor motor, as will be described subsequently. The axis of rotation A of the brake portion 107 is in the position shown in FIG. 4 at the instant in time represented by FIG. 4, but, as is well known to those skilled in the art of orbiting and rotating gerotor devices, the axis of rotation A forms a circle (dashed line) as the star 31 undergoes one complete orbit within the ring member 29.

Referring again to FIGS. 3 and 4 together, the brake member 91 defines a rearward, generally circular surface 109 which is in engagement with the engagement surface 79 of the lock piston 75, whenever the lock piston is biased to the left in FIG. 3 to the engaged position, under the influence of the Belleville washer 85. In the subject embodiment, and by way of example only, the portion of the internal chamber 71, forward of the lock piston 75 comprises a release chamber 111, and whenever the chamber 111 is subjected to a certain, predetermined pressure, the lock piston 75 is biased to the right in FIGS. 1 and 3, in opposition to the biasing force of the Belleville washer 85. The particular arrangement for providing the hydraulic pressure release to the chamber 111 is not an essential feature of the invention. Furthermore, it is not an essential feature of the present invention for the release of the parking brake to be hydraulic, and within the scope of the invention, the release could be by other means, such as, by way of example only, a manual mechanical release.

If the particular vehicle application involves a charge pump, or some other external source of fluid pressure (preferably, at a fairly constant, predictable pressure), such may be communicated to the chamber 111 under the control of an appropriate valve (not shown herein). Alternatively, the motor may be provided with a separate case drain port which may either be communicated to the system reservoir, or may be restricted to cause a back pressure (higher pressure) within the case drain region, which as is well understood by those skilled in the art, is the open chamber surrounding the main drive shaft 51. If case pressure is to be used to disengage the brake, the brake member 91 may be provided with a passage 113, thus permitting communication from the case drain region to the release chamber 111.

The brake member 91 also includes a forward, generally annular surface 115 which, as may best be seen in FIG. 4 is not perfectly annular, but is referred to as being "generally" annular because of the effect of the flat surfaces 97. Thus, the surface 115 represents a substantial amount of area in engagement with the adjacent surface of the wear plate 89.

It has been found during the course of development of the present invention that a Belleville washer which is sufficient to provide the needed brake engagement force will inherently be sufficient also to apply sufficient rotational drag on the lock piston 75 to keep the lock piston from rotating when the brake is being engaged. The significance of the non-rotation of the lock piston 75 will become apparent subsequently.

Under normal operating conditions, when, for example, the motor is propelling the vehicle, it is necessary to disengage the brake. As noted previously, such disengagement may be accomplished by pressurizing the release chamber 111. When the release chamber 111 is pressurized, the lock piston 75 moves somewhat to the right from the position shown in FIG. 1, in opposition to the force of the Belleville washer 85, such that the piston 75 does not apply any substantial axial force to the brake member 91. In the disengaged condition as described, as the brake portion 107 of the drive shaft 51 orbits and rotates, such orbital movement is translated into rotation of the brake member 91 within the chamber 73. The sliding engagement of the surfaces 73 and 93 and of the surfaces 103 and 105 may result in a small decrease in mechanical efficiency, depending upon the radial clearances provided for each of the recited pairs of surfaces.

When it is desired to engage the brake, the release chamber 111 is drained to tank such that the Belleville washer 85 biases the lock piston 75 forwardly (to the left in FIGS. 1 and 3) into the engaged condition. In the engaged condition, the Belleville washer 85 exerts a certain, predetermined axial force F1 against the lock piston 75, which is then applied by the lock piston 75 to the brake member 91, biasing the annular surface 115 into engagement with the wear plate 89. As was noted previously, in the engaged condition, the lock piston 75 does not rotate, such that the circular surface 109 of the brake member 91 is in frictional engagement with the stationary engagement surface 79 of the lock piston 75. At the same time, the annular surface 115 of the brake member 91 is also in engagement with a stationary surface, i.e., the adjacent surface of the wear plate 89.

In accordance with one aspect of the present invention, there are four separate sources of braking torque associated with the brake arrangement of the present invention. Each of those separate sources of braking torque, identified hereinafter as T1, T2, T3 and T4 will be described separately, it being understood that the total braking torque T is the summation of the four individual braking torques.

The braking torque T1 is the result of the engagement of the engagement surface 79 and the circular surface 109 and is determined as follows:

$$T1=F1\times R1\times 6\times \mu l;$$

wherein, R1 equals the diameter of the circular surface 109 divided by 4; $\mu l$ equals the coefficient of static friction at the interface of the surfaces 79 and 109; and 6 equals the number of orbits of the brake portion 107 per revolution of the main drive shaft 51.

The braking torque T2 is that which occurs at the interface of the generally annular surface 115 and the adjacent surface of the wear plate 89 and is calculated as follows:

$$T2=F1\times R2\times 6\times \mu 2;$$

wherein R2 equals the effective diameter of the area of engagement of the surface 115 divided by 4 and the adjacent surface of the wear plate 89; and $\mu 2$ equals the coefficient of static friction at the interface of the surface 115 and the wear plate 89.

The braking torque T3 relates to the engagement of the internal chamber surface 73 and the cylindrical outer surface 93, and is determined as follows:

$$T3 = \frac{(T1 + T2)}{e} \times \mu 3 \times 6 \times \frac{D3}{2};$$

wherein e equals the eccentricity of the axis of rotation A of the brake portion 107; $\mu 3$ equals the coefficient of static friction at the interface of the surfaces 73 and 93; and D3 equals the diameter of the surface 93.

The braking torque T4 relates to the engagement of the internal surface 103 and the outer cylindrical surface 105 and is determined as follows:

$$T4 = \frac{(T1 + T2)}{e} \times \mu 4 \times 7 \times \frac{D4}{2};$$

wherein $\mu 4$ equals the coefficient of static friction at the interface of the surfaces 103 and 105; 7 equals the number of orbits, plus one, of the brake portion 107, per revolution; and D4 equals the diameter of the surface 105.

In the subject embodiment, and by way of example only, the braking torques T1 and T2 together equal approximately ninety percent of the total braking torque, whereas the braking torque T3 equals about eight percent of the total, and the braking torque T4 equals about two percent of the total. It has been observed in connection with the development of the present invention that if the braking torques T3 plus T4 are too high, or become too high, as a percent of the total braking torque, there will be a tendency for the mechanism to actuate on its own, or stated another way, to become "self-locking", which is understood by those skilled in the vehicle brake art to be undesirable.

In the subject embodiment, and by way of example only, the circular surface 109 of the brake member 91 is in direct, frictional engagement with the engagement surface 79 of the lock piston 75. It will be understood that references hereinafter, and in the appended claims, to such frictional engagement include both the direct engagement illustrated herein, as well as indirect engagement which results if some sort of member is interposed between the surfaces 79 and 109. The same would be true if some sort of member were interposed between the surface 115 and the wear plate 89.

It is also within the scope of the present invention to utilize the structure illustrated and described herein, but in association with one or more friction discs, for additional braking torque capacity. Those skilled in the art will recognize that, for whatever braking torque capacity is required, the brake arrangement of the invention will provide at least a portion of the capacity, but at less cost, and in a more compact package. This is especially true because of the fact that the invention takes advantage of the orbiting brake portion 107, whereby the brake member 91 is rotating at orbit speed, thus effectively reducing the area of engagement and normal force (F1) required to achieve a particular braking torque.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A rotary fluid pressure device of the type including a housing defining a fluid inlet and a fluid outlet; a rotary fluid displacement mechanism including an internally-toothed ring member and an externally-toothed star member eccentrically disposed within said ring member for orbital and rotational movement relative thereto, said star member defining a central opening; the teeth of said ring member and said star member interengaging to define expanding and contracting fluid volume chambers in response to said orbital and rotational movement; valve means cooperating with said housing to provide fluid communication from said fluid inlet to said expanding volume chambers, and from said contracting volume chambers to said fluid outlet; a drive shaft including a driven portion in engagement with said central opening of said star member, a drive portion extending forwardly and adapted to drive an output, and a brake portion extending rearwardly, and engaging in orbital and rotational movement; and an endcap assembly disposed rearwardly of said fluid displacement mechanism, and defining an internal chamber, and a lock piston disposed in said internal chamber, said lock piston being moveable between a first, retracted position, and a second, engaged position; characterized by:

(a) said endcap assembly defining a generally cylindrical brake chamber, said brake portion of said drive shaft extending axially into said brake chamber;

(b) a generally cylindrical brake member disposed in said brake chamber and being driven eccentrically by said brake portion of said drive shaft, said brake member including a first, generally circular surface disposed for frictional engagement with said lock piston when said lock piston is in said engaged position, and a second, generally annular surface disposed for frictional engagement with said fluid displacement mechanism when said lock piston is in said engaged position.

2. A rotary fluid pressure device as claimed in claim 1, characterized by said generally cylindrical brake member including a cylindrical outer surface in frictional engagement with an internal, generally cylindrical surface defined by said brake chamber when said lock piston is in its engaged position, and in response to the orbital movement of said brake portion of said drive shaft.

3. A rotary fluid pressure device as claimed in claim 1, characterized by said brake portion of said drive shaft including an outer cylindrical surface in frictional engagement with a cylindrical internal surface of a spinner member which is eccentrically received within said brake member, whereby orbital movement of said brake portion results in rotational movement of said brake member at orbit speed.

4. A rotary fluid pressure device as claimed in claim 3, characterized by said brake member defining flat internal surfaces, and said spinner member defines a set of flat external surfaces in engagement with said internal surfaces as said brake portion orbits and rotates.

* * * * *